United States Patent [19]

Klein

[11] 4,201,961

[45] May 6, 1980

[54] UNIDIRECTIONAL PHASE SHIFTER

[75] Inventor: Gerald I. Klein, Baltimore, Md.

[73] Assignee: Westinghouse Electric Corp., Pittsburgh, Pa.

[21] Appl. No.: 916,166

[22] Filed: Jun. 16, 1978

[51] Int. Cl.[2] ..... H01P 1/40

[52] U.S. Cl. ..... 333/24.1; 333/21 A

[58] Field of Search ..... 333/21 A, 24.1, 31 A

[56] References Cited

U.S. PATENT DOCUMENTS

| | | | |
|---|---|---|---|
| 2,438,119 | 3/1948 | Fox | 333/31 |
| 2,787,765 | 4/1957 | Fox | 333/21 |
| 2,858,512 | 10/1958 | Barnett | 333/21 A |
| 3,626,335 | 12/1971 | Hord et al. | 333/24.1 X |
| 3,698,008 | 10/1972 | Roberts et al. | 333/24.1 X |
| 3,845,421 | 10/1974 | Charlton et al. | 333/21 A X |
| 3,982,213 | 9/1976 | Smith et al. | 333/24.1 X |

*Primary Examiner*—Paul L. Gensler
*Attorney, Agent, or Firm*—B. W. McGee

[57] ABSTRACT

A unidirectional phase shifter provides selectable phase changes for linearly polarized microwaves of electromagnetic radiation entering the phase shifter in one direction and constant insertion phase for linearly polarized microwaves entering the phase shifter in the opposite direction. The phase shifter consists of two ferrite phasor sections arranged such that the phase changes of the two sections add for one direction of signal flow and cancel for the other. Each phasor section includes a ferrite half-wave plate, at one end of which is coupled a ferrite quarter-wave plate, and at the other end of which is coupled a dielectric quarter-wave plate. The dielectric quarter-wave plate of one of the phasor sections is coupled to the ferrite quarter-wave plate of the other phasor section.

7 Claims, 13 Drawing Figures

UNIDIRECTIONAL PHASE SHIFTER

BACKGROUND OF THE INVENTION

1. Field of the Invention

This invention relates to guided electromagnetic wave transmission systems and, more particularly, to phase changing or phase shifting devices for use in such systems.

2. Description of the Prior Art

It is well known that a round or square waveguide section that produces a 90-degree differential phase shift between two orthogonal waves (quarter-wave plate) may be used to convert an electromagnetic wave either from linear to circular polarization or from circular to linear polarization. It is also well known that a 180-degree differential phase shift section (half-wave plate) may be used to change the sense of a circularly polarized electromagnetic wave, e.g., from right circularly polarized to left circularly polarized.

In U.S. Pat No. 2,438,119 issued to Fox, a system is described which makes use of these properties in order to provide an adjustable phase changer which changes the phase of an electromagnetic wave while producing no change in the polarization of the wave. Such a system uses a rotatable 180-degree phase shift section interposed between two 90-degree phase shift sections. A similar phase changer, described by Fox in U.S. Pat. No. 2,787,765, has been implemented using a constant transverse magnetic field to excite an element of ferromagnetic material in order to effect an electrically controlled or adjustable phase change with no change in polarization.

It is often desired to be able to change the phase of electromagnetic waves travelling or propagating in one direction in a controlled manner while providing no variable phase change for such waves travelling or propagating in the opposite direction, i.e., to have a unidirectional phase changer.

For example, it is often desired to have an antenna pattern that scans for one directon of signal flow only as where a changing phase shift is desired in the receive direction of the antenna for scanning purposes and where constant phase is desired in the transmit direction for providing an on axis beam.

There are many other types of microwave signal processing applications in which a device providing such a signal flow, i.e., unidirectional variable phase, is useful.

In the prior art, such a signal flow is provided, for example, in a device including a combination of junction circulators and phase shifters. Typically, however, circulators provide poor signal isolation, which results in leakage of the input signal, causing some residual phase change in the non-phase shifting direction, and limiting the accuracy of the phase shifting direction.

SUMMARY OF THE INVENTION

According to the present invention, a phase shifter is provided comprising two cascaded phasor sections arranged such that the phase changes of the two sections add for one direction of signal flow and cancel for the other direction. Each phasor section consists of a ferrite half-wave plate on one end of which is coupled a ferrite quarter-wave plate and on the other end of which is coupled a dielectric quarter-wave plate. The dielectric quarter-wave plate of one phasor section is coupled to the ferrite quarter-wave plate of the other phasor section in each of two embodiments. The resulting phase shifter includes a ferrite quarter-wave plate at one end and a dielectric quarter-wave plate at the other end.

The quarter-wave plates are effective to convert linearly polarized microwaves to circularly polarized micro-waves. The half-wave plates are effective to reverse the sense of the circularly polarized microwave received from the quarter-wave plate. In addition, the half-wave plate changes the phase of the circularly polarized microwaves by a positive or negative amount depending on the angular orientation of the principal axis of the half-wave plate relative to the angular orientation of the principal axis of the quarter-wave plates and the direction of propagation of the microwave signals. In one direction, rotation of the two half-wave plates change the phase of the microwave signals an equal and positive amount such that the total phase change of the phase shifter is twice that introduced by each half-wave plate. In the opposite direction, one half-wave plate effects a phase shift of a positive amoung and the other half-wave plate effects a phase shift of an equal but negative amount such that the net phase change for microwave signals propagating through the phase shifter in the opposite direction is zero.

DESCRIPTION OF THE PREFERRED EMBODIMENT

Figure 1A:
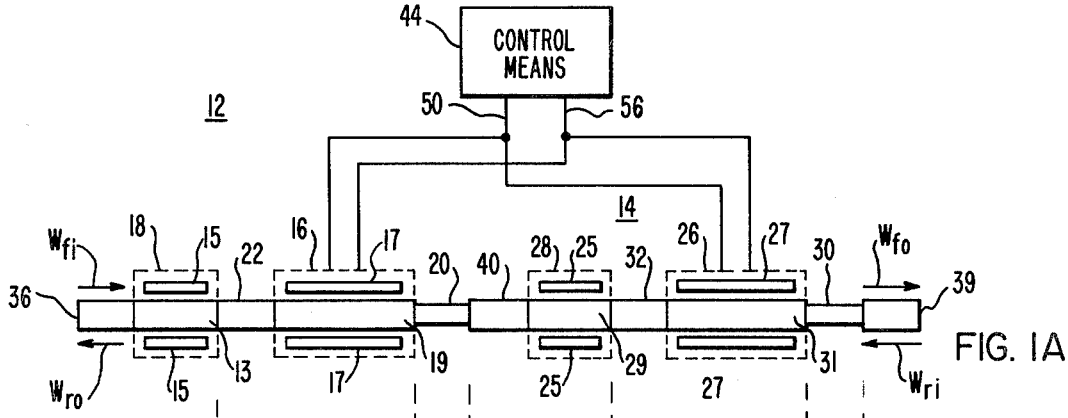
FIG. 1A is a block diagrammatic view of a variable phase shifter according to the present invention.

FIG. 1A shows a first phasor 12 including, for example, a ferrite quarter-wave plate 18 coupled by a waveguide 22 to a ferrite half-wave plate 16 to which is coupled a dielectric quarter-wave plate 20. A second phasor 14 includes, for example, a ferrite quarter-wave plate 28 coupled by a waveguide 32 to a ferrite half-wave plate 26 which is coupled to a dielectric quarter-wave plate 30. Wave plates 20 and 30 may be, for example, a ceramic dielectric quarter-wave plate based upon the well-known broadband dielectric slab design.

Waveguide 40 couples the two phasor sections 12 and 14. Waveguides 36 and 39 are conventional input and output waveguides, respectively. The quarter-wave plate 18 includes, for example, a cylinder or rod of ferrimagnetic material 13 encircled by transverse quadrupole field permanent magnets 15. Similarly the quarter-wave plate 28 includes, for example, a cylinder or rod of ferrimagnetic material 29 encircled by transverse quadrupole field permanent magnets 25. The half-wave plate 26 includes, for example, a cylinder or rod of ferrimagnetic material 29 encircled by an electromagnetic yoke 17. Similarly, the half-wave plate 26 includes, for example, a cylinder or rod of ferrimagnetic material 31 encircled by an electromagnetic yoke 27. Ferrimagnetic rods 19 and 31 can be comprised of, for example, magnesium manganese ferrite, lithium ferrite, or yttrium-iron garnet material with appropriate properties for low microwave transmission loss. Ferrimagnetic rods 13 and 29 can be comprised of, for example, the same material as used in rods 19 and 3l. Electromagnetic yokes 17 and 27 are effective in conjunction with control means 44 to provide a rotatable transverse quadrupole field about the plates 16 and 26 in order to vary the amount of phase change caused thereby.

The action of quarter-wave plates and half-wave plates upon electromagnetic energy propagating therethrough is adequately described and explained, for example, by Fox in U.S. Pat. No. 2,438,119. The effect of ferrite quarter-wave plates and ferrite half-wave plates, in particular, is discussed by Fox, in U.S. Pat. No. 2,787,765. A quarter-wave plate, in general, is effective to convert linearly polarized electromagnetic energy propagating therethrough in either direction into circularly polarized electromagnetic energy. Half-wave plates, in general, are effective to reverse the sense of circularly polarized electromagnetic energy propagating therethrough in either direction, for example, from right circularly polarized energy to left circularly polarized energy, and to change the phase of the electromagnetic energy propagating therethrough as a function of the angular rotation of the half-wave plate relative to the fixed quarter-wave plates. It is to be understood that the phase change referred to throughout the description of the operation of the invention is in addition to the inherent (fixed) insertion phase characteristics of the total microwave assembly including phasors 12 and 14, i.e., computations are normalized so that the insertion or fixed phase length of each of the elements of the total microwave assembly is considered a zero phase change. The input and output waveguides 36 and 39, respectively, function to support only linearly polarized electromagnetic waves as explained by Fox in U.S. Pat. No. 2,787,765.

Figure 1B:
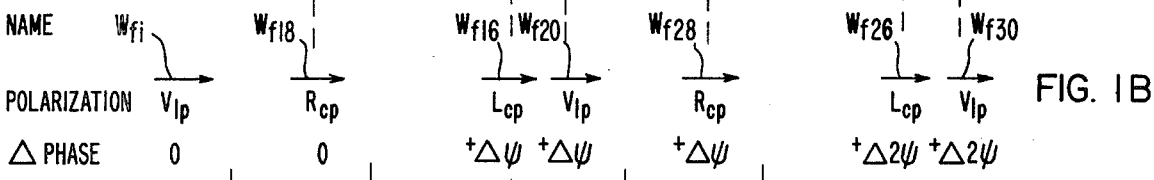
FIGS. 1B and 1C illustrate the change in polarization and phase of a vertical linearly polarized wave traveling through the phase shifter of FIG. 1A in the forward and reverse directions, respectively.

FIG. 1B shows a signal flow or wave flow diagram for microwaves or electromagnetic energy propagating through the device of FIG. 1A in the forward direction as shown by the arrow $W_{fi}$. The subscript "f" of the arrows of FIG 1B indicate waves traveling in the forward direction. The subscripts "i" and "o" indicate input and output waves, respectively. The numerical subscripts refer to a wave emerging from a device of corresponding character reference in FIG. 1A. The half-wave plates 16 and 26 are assumed to have been rotated about their longitudinal axis by an angle $\psi/2$ relative to the fixed quarter-wave plates. In FIG. 1B, a vertical linearly polarized ($V_{lp}$) wave or energy $W_{fi}$ enters the ferrite quarter-wave plate 18 from the waveguide 36. The quarter-wave plate 18 is effective to convert the $V_{lp}$ wave $W_{fi}$ to a right circularly polarized ($R_{cp}$) wave $W_{f18}$. The waveguide 22 coupling the quarter-wave plate 18 and the ferrite half-wave plate 16 serves a coupling function only and has no effect on the $R_{cp}$ wave $W_{f18}$. The half-wave plate 16 is effective to reverse the sense of the $R_{cp}$ wave $W_{f18}$ propagating therethrough and advance the phase of the wave by an angle $\Delta\psi$ resulting in a left circularly polarized ($L_{cp}$) wave $W_{f16}$ the phase of which is advanced by $\Delta\psi$ degrees with respect to the input wave $W_{fi}$. As mentioned hereinbefore this advance in phase of $\psi$ degrees is in addition to the inherent or fixed phase change caused by the elements 36, 18, 22, and 16 of the phasor 12. The dielectric quarter-wave plate 20 is effective to convert the $L_{cp}$ wave $W_{f16}$ to a $V_{1p}$ wave $W_{f20}$having, of course, a phase angle $\Delta\psi$ degrees advance with respect to the phase of wave $W_{fi}$.

The waveguide 40 coupling the dielectric quarter-wave plate 20 of phasor 12 to the ferrite quarter-wave plate 28 of phasor 14 serves a coupling function only and has no effect upon the phase or polarization of the $V_{1p}$ wave $W_{f20}$. The $V_{1p}$ wave 20 propagates through the ferrite quarter-wave plate 28 and is converted, as described hereinbefore with reference to the wave plate 18, to a $R_{cp}$ wave $W_{f28}$. The wave $W_{f28}$ propagates through the coupling waveguide 32 unaffected and enters the ferrite half-wave plate 26 which plate 26 is effective to reverse the sense of $R_{cp}$ wave $W_{f28}$ from right to left and advance the phase thereof by the angle $\Delta\psi$. The yokes 17 and 27 are so connected that the electromagnetic field produced causes an angle $\Delta\theta$ of advance that is the same for each of the plates 16 and 26. The wave emerging from the plate 26, then, is $L_{cp}$ wave, the phase of which is advanced by $\Delta\psi$ degrees from the phase of $V_{1p}$ wave $W_{f20}$ and is advanced by $\Delta 2\psi$ degrees with respect to phase of $V_{1p}$ wave $W_{fi}$. The dielectric quarter-wave plate 30 is effective to convert the $L_{cp}$ wave $W_{f26}$ to a $V_{1p}$ wave $W_{f30}$, the phase of which is $\Delta 2\psi$ degrees advanced with respect to the $V_{1p}$ wave $W_{fi}$ over the fixed insertion phase of the microwave assembly. The output wave $W_{fo}$ propagating through waveguide 39 in the forward direction is a $V_{1p}$ wave having a phase that differs from the phase of input wave $W_{fi}$ by the fixed insertion phase of the microwave assembly plus $\Delta 2\psi$ degrees.

Figure 1C:
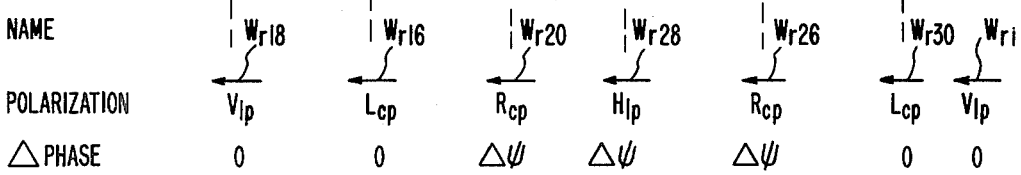

FIG. 1C shows a signal flow or wave flow diagram for microwaves or electromagnetic energy propagating through the device of FIG. 1A in the reverse direction as shown by the arrow $W_{ri}$. The subscript r of the arrows of FIG. 1C indicate waves traveling in the reverse direction. The subscripts i, o, and the numerical subscripts have a meaning similar to that described with reference to FIG. 1B. In FIG. 1C, a $V_{1p}$ wave $W_{ri}$ propagates through the quarter-wave plate 30 and is converted to a $L_{cp}$ wave $W_{r30}$. However, as wave $W_{r30}$ propagates through the ferrite half-wave plate 26, its phase is advanced by an angle $\Delta\psi$ and a $R_{cp}$ wave $W_{r26}$ emerges having a phase advanced by an angle $\Delta\psi$ with respect to the input wave $W_{ri}$. In the reverse direction, the ferrite quarter-wave plate 28 converts the $R_{cp}$ wave $W_{r26}$ to a horizontal linearly polarized ($H_{1p}$) wave $W_{r28}$ having, of course, a phase advanced from the phase of input wave $W_{ri}$ by an angle of $\Delta\psi$ degrees.

The $H_{1p}$ wave $W_{r28}$ emerging from the ferrite quarter-wave plate 28 of phasor 14 enters the dielectric quarter-wave plate 20 of phasor 12 and is converted to a $R_{cp}$ wave $W_{r20}$. The ferrite half-wave plate 16, then, is effective to reverse the sense of the wave $W_{r20}$ from left to right and retard the phase of the wave $W_{r20}$ by an angle $\Delta\psi$ resulting in an $L_{cp}$ wave $W_{r16}$ having a phase retarded by an angle $\Delta\psi$ with respect to the wave $W_{r28}$. But, since the phase of wave $W_{r28}$ was advanced by an angle of $\Delta\psi$ degrees with respect to input wave $W_{ri}$ and the phase of wave $W_{r16}$ is retarded by the same angle $\Delta\psi$, the phase of wave $W_{r16}$ is equal to the phase of input wave $W_{ri}$, i.e., there is no net phase change over the inherent phase change of the device for microwaves propagating through the device of FIG. 1A in the reverse direction. The wave $W_{r16}$ propagates through the ferrite quarter-wave plate 18 and is converted to a $V_{1p}$ wave $W_{r18}$. The output wave $W_{ro}$ propagating through wave guide 36 in the reverse direction is a $V_{1p}$ wave having a phase that differs from the phase of input wave $W_{ri}$ only by the fixed insertion phase of the total microwave assembly.

Figure 2:
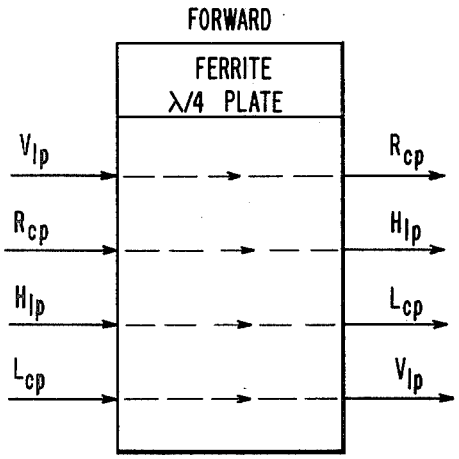
FIGS. 2 and 3 show the effect of the ferrite quarter-wave plates of FIG. 1A on several types of waves traveling therethrough in the forward and reverse directions, respectively.
Figure 3:
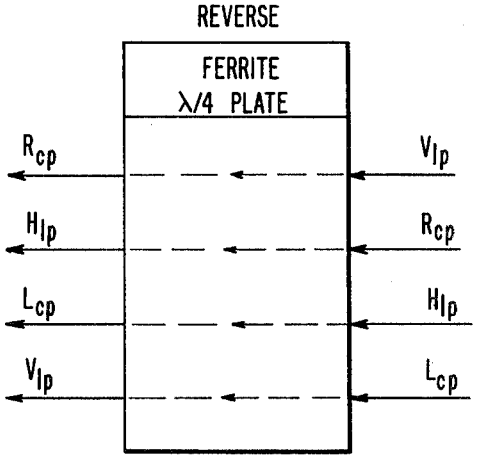
Figure 4:
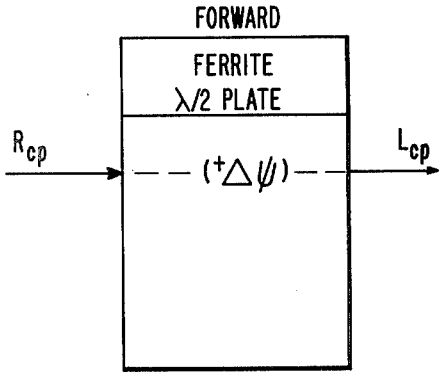
FIGS. 4 and 5 show the effect of the ferrite half-wave plates of FIG. 1A on several types of waves traveling therethrough in the forward and reverse directions, respectively.
Figure 5:
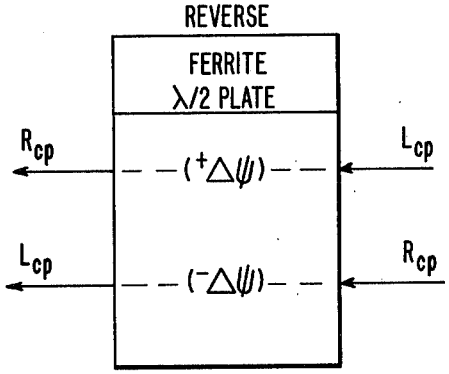
Figure 6:
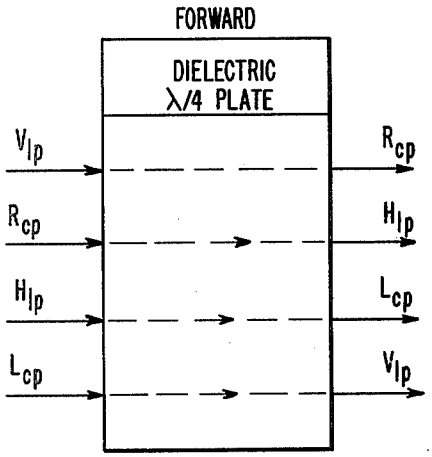
FIGS. 6 and 7 show the effect of the dielectric quarter-wave plate of FIG. 1A on several types of waves traveling therethrough in the forward and reverse directions, respectively.
Figure 7:
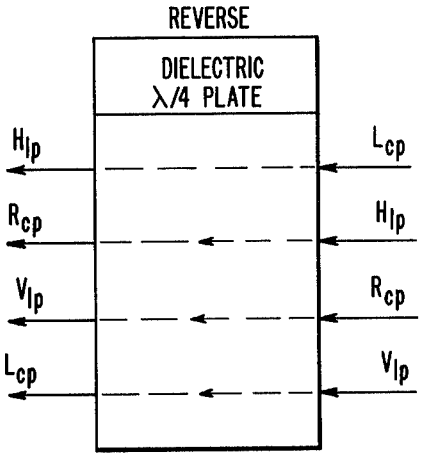

FIGS. 2 through 7 provide further elucidation of the principles of operation of the constituent parts of the present invention. FIGS. 6 and 7 illustrate the conversion effect of a type of dielectric quarter-wave plate, such as the wave plates 20 and 30 of FIG. 1A for various types of input wave propagating therethrough in the forward and reverse directions, respectively. FIGS. 2 and 3 illustrate the conversion effect of a type of ferrite quarter-wave plate, such as the wave plates 18 and 28 of FIG. 1A for various types of input waves propagating therethrough in the forward and reverse directions, respectively. FIGS. 4 and 5 illustrate the effect of a type of ferrite half-wave plate such as the wave plates 16 and 26 in FIG. 1A for various types of input waves propagating therethrough in the forward and reverse directions, respectively.

Figure 9:
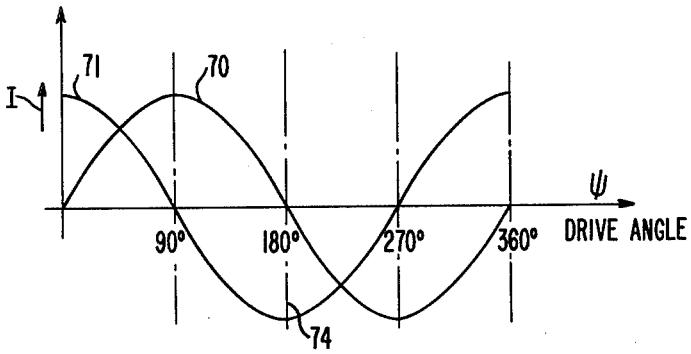
FIG. 9 shows a set of curves illustrative of the excitations supplied to the windings of the yokes of FIG. 1A in accordance with the invention.
Figure 8:
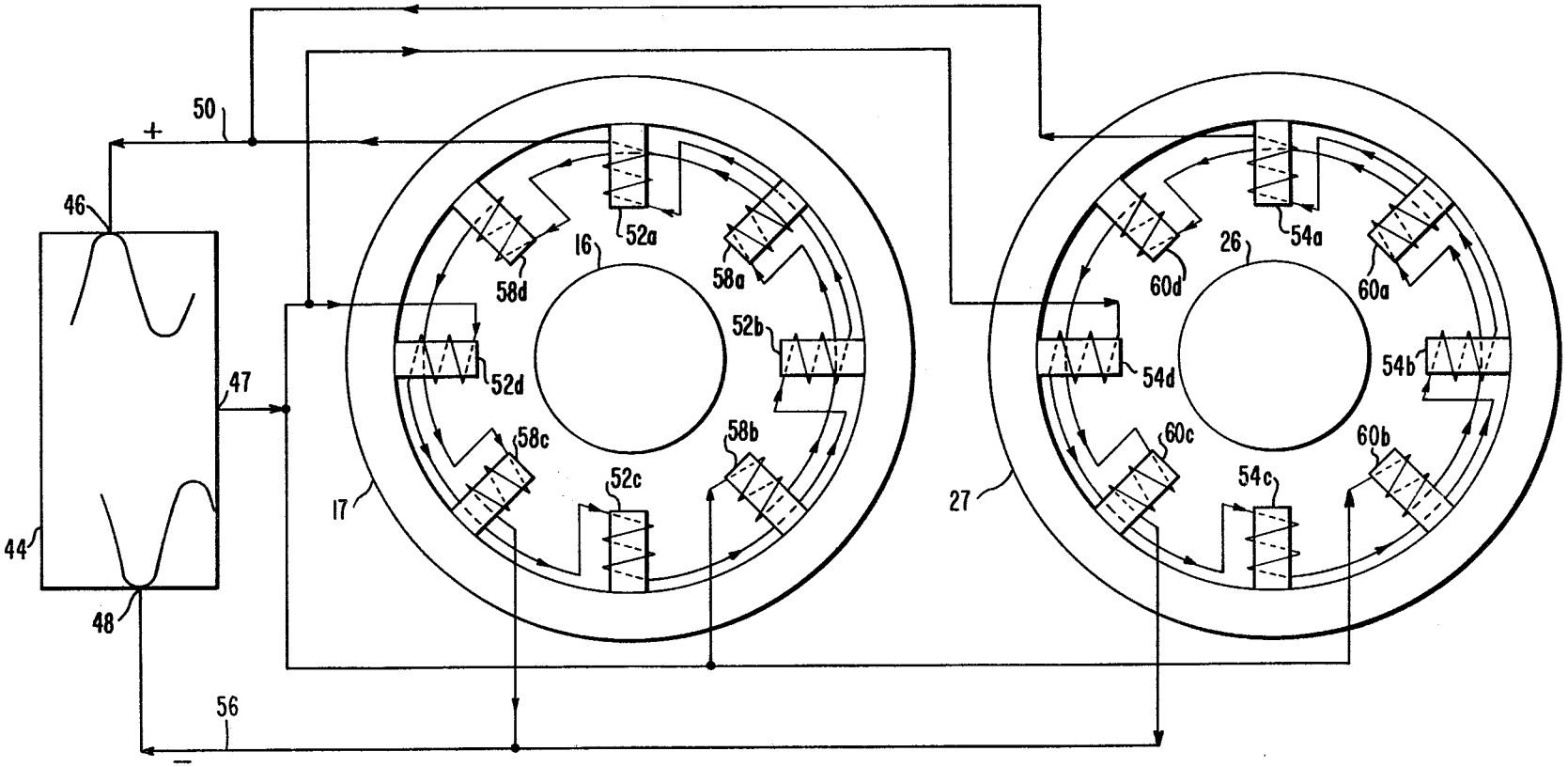
FIG. 8 is a more detailed view of how the control means of FIG. 1A can be coupled to the electromagnetic yokes of FIG. 1A.

FIG. 8 is a more detailed view of how the control means 44 of FIG. 1A can be coupled to the yokes 17 and 27. For example, sine winding 50 and cosine winding 56 are effective to couple, respectively, the yokes 17 and 27 to the control means 44. The two interlaced windings 50 and 56 are designated as the "sine" and "cosine" windings, respectively, because of the field patterns generated by their respective excitations, i.e., a sine excitation corresponding to a curve 70 of FIG. 9 is supplied to the winding 50 at the terminal 46 of the control means 44 and a cosine excitation corresponding to a curve 71 of FIG. 9 is supplied to the winding 56 at the terminal 48 of the control means 44. Sine winding 50 is coupled to poles **52*a*, 52*b*, 52*c*, and 52*d* of the yoke 17 and is coupled to poles 54*a*, 54*b*, 54*c*, and 54*d* of the yoke 27. Cosine winding 56 is coupled to poles 58*a*, 58*b*, 58*c*, and 58*d* and is coupled to poles 60*a*, 60*b*, 60*c*, and 60*d* of the yoke 27. Both windings 50 and 56 are returned to ground at a terminal 47 of the control means 144. It is to be understood that the number of poles comprising yokes 17 and 27 is variable and that the use of eight poles in FIG. 8** is for purposes of illustration only.

When an electrical sine excitation corresponding to curve 70 in FIG. 9 is supplied to the sine winding 50, a radial magnetic field $B_s$ is produced, around the ferrite half-wave plates 16 and 26 in accordance with equation 1:

$$B_2 = B_{so} \sin 2\psi \quad (1)$$

Similarly, when an electrical cosine excitation corresponding to curve 71 in FIG. 9 is supplied to the cosine winding 56, a radial magnetic field $B_c$ is produced around the ferrite half-wave plates 16 and 26 in accordance with equation 2:

$$B_c = B_{co} \cos 2\psi \quad (2)$$

Neglecting saturation effects, the total radial magnetic field B produced around the plates 16 and 26 will be the superposition of the two fields $B_s$ and $B_c$ in accordance with equation 3:

$$B = B_s + B_c = B_{so} \sin 2\psi + B_{co} \cos 2\psi \quad (3)$$

If the magnitudes of the fields $B_{so}$ and $B_{co}$ are varied as $B_o \sin \theta$ and $B_o \cos \theta$, respectively, the resultant field in accordance with equations 4 and 5:

$$B = B_o(\sin \theta \sin 2\psi + \cos \theta \cos 2\psi) \quad (4)$$

$$B = B_o \cos (2\psi - \theta) \quad (5)$$

Figure 10:
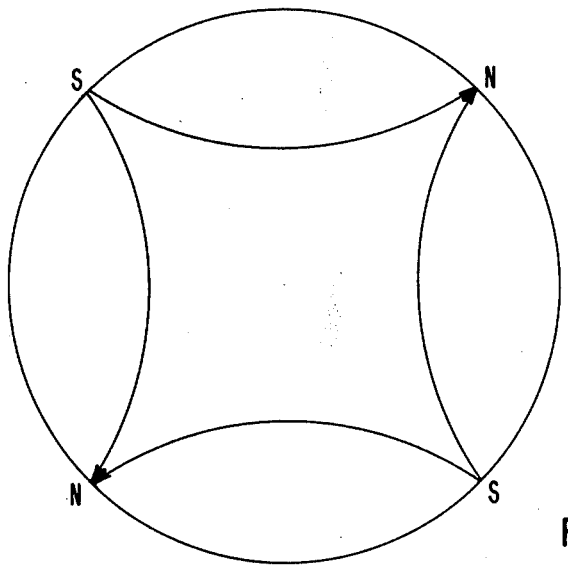
FIGS. 10 and 11 show typical magnetic conditions existing around the half-wave plates of FIG. 1A in accordance with the operation of the present invention.
Figure 11:
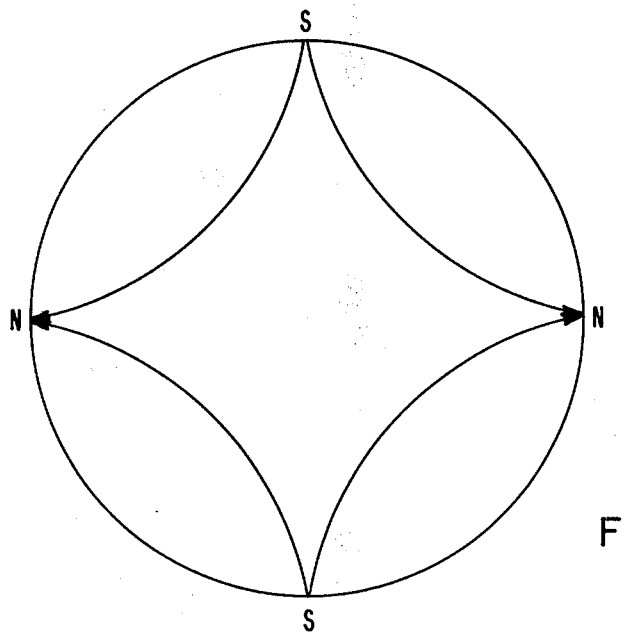

It is seen that the quadrupole excitation orientation is rotated through a mechanical angle $\psi_o = \theta_o/2$ when a current drive angle of $\theta_o$ is introduced. Since the r-f phase shift angle is proportional to twice the mechanical rotation, it follows that a change of $\theta_o$ degrees in electrical excitation will also produce $\theta_o$ degrees of r-f phase shift in a single phase shifter. Since two phase shifters are cascaded, the overall transmission phase through the two phase shifters will change by $2\theta_o$ degrees for a drive angle change of $\theta_o$ degrees. FIG. 10 shows the magnetic conditions existing around the plates 16 and 26 where the windings 50 and 56 are interlaced as shown in FIG. 8 and the excitations applied to the windings 50 and 56 correspond to the position of the curves 70 and 71, respectively, of FIG. 9 at a drive angle $\psi$ of 90 degrees. North and south magnetic poles exist at approximately 45° angles from the vertical as shown. When a drive angle $\psi$ of 180 degrees is applied to windings 50 and 56 of FIG. 8 corresponding to the points on the curves 70 and 71, respectively, of FIG. 9 intersected by a dashed line 74, i.e., at a drive angle of 180 degrees, FIG. 11 shows the result of applying such excitations. North and south magnetic poles exist at right angles to the vertical. FIG. 9 shows, in general, drive angle $\psi$ for a single ferrite half-wave plate as a function of the combination of excitation applied to the windings 50 and 56 of FIG. 8.

What is claimed is:

1. Variable phase change apparatus providing a fixed phase change for electromagnetic energy propagating therethrough in a first direction and a variable phase change in addition to said fixed phase change for electromagnetic energy propagating therethrough in a direction opposite said first direction, said electromagnetic energy being characterized by linear or circular polarization, said circularly polarized electromagnetic energy being characterized by first or second senses, said phase change apparatus comprising:

(a) first and second cascaded differential phasor sections each including:

(1) first and second converting means each of which for converting linearly polarized electromagnetic wave energy to circularly polarized energy and for converting circularly polarized electromagnetic wave energy to linearly polarized energy; and (2) phase changing means interposed therebetween for reversing the sense of circularly polarized energy propagating therethrough in said first direction or said opposite direction and for effecting a nonreciprocal phase change for circularly polarized energy having said first sense and propagating therethrough in said opposite direction or having said first sense and propagating therethrough in said first direction; and (b) means for coupling the first converting means of said first differential phasor to the second converting means of said second differential phasor.

2. The apparatus of claim 1 wherein:

said first and second converting means includes first and second 90-degree differential phase change sections, respectively; and, said phase changing means each includes a 180-degree differential phase change section.

3. The apparatus of claim 2 wherein:

said first 90-degree phase change sections each includes a first element of ferrimagnetic material and electromagnetic means thereabout for converting linearly polarized electromagnetic wave energy to circularly polarized energy and for converting circularly polarized electromagnetic energy to linearly polarized wave energy;

said second 90-degree phase change sections each includes an element of dielectric material; and, said 180-degree phase change sections each includes a second element of ferrimagnetic material and electromagnetic means thereabout for reversing the sense of circularly polarized wave energy and for effecting reciprocal and non-reciprocal phase changes for said energy.

4. The apparatus of claim 3 wherein:

the electromagnetic means disposed about said 180-degree phase change section includes magnetic field means for applying separate magnetic fields of equal magnitude to each of said second elements of gyromagnetic material in a direction transverse to the direction of propagation of said wave energy.

5. The apparatus of claim 4 wherein:

said field means includes electromagnetic solenoids disposed about each of said second elements.

6. The apparatus of claim 2 wherein:

said first 90-degree phase change sections each includes an element of dielectric material;

said second 90-degree phase change sections each includes a first element of ferrimagnetic material and permanent magnet means disposed thereabout for converting linearly polarized electromagnetic wave energy to circularly polarized energy and for converting circularly polarized electromagnetic energy to linearly polarized wave energy; and, said 180-degree phase change sections each includes a second element of ferrimagnetic material and electromagnetic means disposed thereabout for reversing the sense of circularly polarized wave energy and for effecting reciprocal or non-reciprocal phase changes for said energy.

7. A unidirectional phase shifter for providing selectable phase changes for linearly polarized microwaves of electromagnetic radiation entering said phase shifter in a first direction and a fixed insertion phase for linearly polarized microwaves entering said phase shifter in a second direction opposite said first direction, said phase shifter comprising:

first and second ferrite phasor sections arranged such that the phase changes of the two sections add for signal flow in said first direction and cancel for signal flow in said second direction;

said first and second phasor sections each including a ferrite half-wave plate, a ferrite quarter-wave plate at a first end thereof, and a dielectric quarter-wave plate at a second end thereof; and means for coupling the dielectric quarter-wave plate of said first phasor section to the ferrite quarter-wave plate of said second phasor section.

* * * * *